US005255059A

United States Patent [19]

Kai et al.

[11] Patent Number: 5,255,059

[45] Date of Patent: Oct. 19, 1993

[54] IMAGE FORMING APPARATUS

[75] Inventors: Tsukuru Kai, Fujisawa; Seiji Oka, Yokohama; Hidetoshi Yano, Yokohama; Shigeru Yoshiki, Yokohama; Tsuyoshi Deki, Kawasaki, all of Japan

[73] Assignee: Ricoh Company, Ltd., Tokyo, Japan

[21] Appl. No.: 851,539

[22] Filed: Mar. 13, 1992

[30] Foreign Application Priority Data

Mar. 15, 1991 [JP] Japan ..... 3-76797

[51] Int. Cl.[5] ..... G03G 15/06

[52] U.S. Cl. ..... 355/261; 355/245; 355/259; 355/262; 118/647; 118/648; 118/651; 118/661

[58] Field of Search ..... 355/245, 246, 259, 261, 355/262, 251, 253; 118/644, 647-648, 651, 653, 661, 656, 657

[56] References Cited

U.S. PATENT DOCUMENTS 4,273,069 6/1981 Huggins et al. ..... 355/245 X
4,794,878 1/1989 Connors et al. ..... 355/259 X

FOREIGN PATENT DOCUMENTS 0173276 8/1986 Japan .
0176960 8/1986 Japan .
0049386 3/1987 Japan .

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

An image forming apparatus having a developing device which includes a developing roller. A developer or a toner is transported on and along the developing roller without the roller being rotated. The developing roller has a shaft and ultrasonic transport members provided on the shaft. The ultrasonic transport members are made up of a plurality of electrodes, a piezoelectric member surrounding the electrodes and made of, for example, piezoelectric ceramic, and an elastic member surrounding the piezoelectric member and made of, for example, copper alloy or similar alloy. A plurality of standing waves are caused to flow through the electrodes with the result that the piezoelectric member waves. The toner is transported on the waving surface of the elastic member.

6 Claims, 3 Drawing Sheets

IMAGE FORMING APPARATUS

BACKGROUND OF THE INVENTION

The present invention relates to an electrophotographic copier, facsimile transceiver, printer or similar electrostatic recording apparatus and, more particularly, to means incorporated in a developing device for transporting a developer or a toner to the surface of an image carrier.

It has been customary with a developing device to transport a developer or a toner deposited on the surface of a developing roller to a latent image electrostaically formed on an image carrier, i.e., photoconductive element by rotating the developing roller. In this sense, the developing roller plays the role of developer transporting means. After the development, the developer or the toner remaining on the photoconductive element is collected in the developing device and again transported to the photoconductive element by the developing roller. A problem with such a construction is that part of the toner enters the clearances between the developing roller and the side walls of the developing device which support the roller due to the rotation of the roller. This part of the toner rubs against the developing roller and side walls and binds, disturbing images to be formed. Moreover, when the developing roller is implemented as a sleeve accommodating a magnet roller therein, the sleeve generates eddy current as it moves across the magnetic field of the magnet roller. The eddy current is apt to increase the torque acting on the developing roller and to cause the toner to melt in the developing device because of heat generated in the roller.

SUMMARY OF THE INVENTION

It is, therefore, an object of the present invention to provide an image forming apparatus which eliminates the above-discussed problems and, in addition, simplifies the construction of a developing unit by transporting a developer or a toner on a developing roller without causing the roller to rotate.

In accordance with the present invention, in an image forming apparatus having a developing device for developing a latent image electrostatically formed on an image carrier by a toner, the developing device comprises developer transporting means implemented as ultrasonic transporting means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
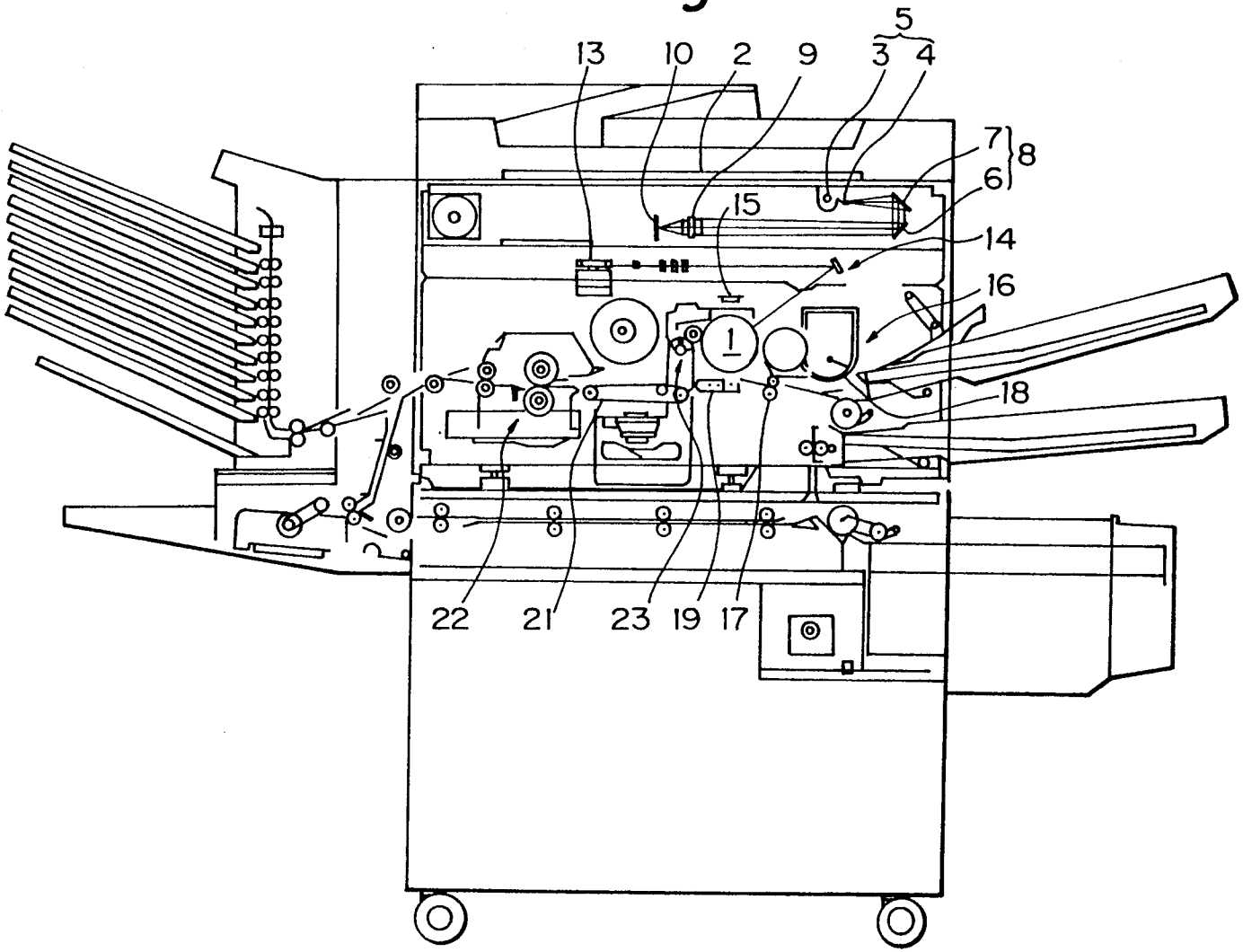
FIG. 1 shows the general construction of an image forming apparatus embodying the present invention.

Referring to FIG. 1 of the drawings, an image forming apparatus embodying the present invention is shown and includes an image carrier in the form of a photoconductive drum 1. The drum 1 may be implemented by an organic photoconductor (OPC) and is rotated clockwise as viewed in the figure. When a document is laid on a glass platen 2 and then a print switch, not shown, is pressed, optics 5 made up of a lamp 3 and a mirror 4 and optics made up of mirrors 6 and 7 are moved to read the document by scanning it. An image reading device 10 is located behind a lens 9 and outputs an image signal representative of the scanned image of the document. The image signal is digitized and then subjected to various kinds of image processing. A laser diode (LD), not shown, is driven on the basis of the processed image signal. A laser beam issuing from the LD scans the drum 1 via a mirror 14 by being steered by a polygonal mirror 13. As a result, a latent image representative of the document image is electrostatically formed on the drum 1 which has been uniformly charged beforehand. A developing device 16 develops the latent image to produce a corresponding toner image. As a paper sheet is fed from a paper feed section 17, the toner image is transferred from the drum 1 to the sheet by the corona discharge of a transfer charger 18. The recording sheet carrying the toner image is separated from the drum 1 by a separation charger 19 and then transported to a fixing roller pair 22 by a transport belt 21. After the toner image has been fixed on the recording sheet by the fixing roller pair 22, the sheet is driven out of the apparatus. The toner remaining on the drum 1 after the image transfer is removed by a cleaning device 23.

Figure 2:
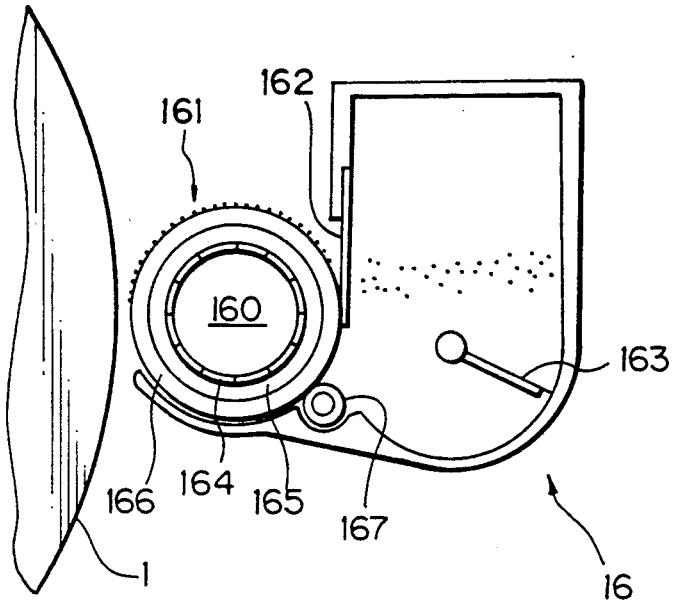
FIG. 2 is a view showing a developing unit included in the embodiment.

FIG. 2 shows a specific construction of the developing device 16. As shown, the developing device 16 has a developing roller 161, a blade 162 for forming a thin toner layer on the roller 161, and an agitator 163 for agitating the toner. A toner end condition is detected on the basis of the torque of the agitator 163, i.e., the developing device 16 is determined to have run out of toner when the torque acting on the agitator 163 decreases. The developing roller 161 has a shaft 160 and ultrasonic transport members provided on the shaft 160. The ultrasonic transport members are constituted by a plurality of electrodes 164 arranged on the shaft 160, a piezoelectric member 165 (e.g. piezoelectric ceramic surrounding the electrodes 164), and an elastic member 166 (e.g. copper alloy or similar alloy) surrounding the piezoelectric member 165. A plurality of standing waves are caused to flow through the electrodes 164 with the result that the piezoelectric member 165 and, therefore, the resilient member 166 waves. The toner is transported by the waving surface of the resilient member 166. In the illustrative embodiment, the surfaces of the developing roller 161 and drum 1 are spaced apart by a distance greater than the thickness of the toner layer in order to effect non-contact type development. Alternatively, the gap between the roller 161 and the drum 1 may be so selected as to cause the toner layer on the roller 161 to contact the drum 1, i.e., to effect contact type development. As the waves advance in the counterclockwise direction on the surface of the developing roller 161, the toner is conveyed in the same direction on the roller 161, as will be described specifically later.

In operation, the agitator 163 conveys the toner from the toner hopper to the developing roller 161 while agitating it. The toner deposited on the developing roller 161 is regulated by the blade 162 to form a thin toner layer on the roller 161. The thin toner layer is transported by ulstrasonic waves to the position where the developing roller 161 faces the drum 1, thereby developing an electrostatic latent image formed on the drum 1. The toner left on the developing roller 161 after the development is returned to the developing device 16 and then removed from the roller 161 by an elastic roller 167 which is in rotation. The roller 167 additionally function to frictionally charge the toner fed to the surface of the developing roller 161, so that the toner may deposit on the roller 161.

The principle of toner transport particular to the embodiment and using ultrasonic oscillations will be described hereinafter.

Ultrasonic waves refer to the elastic oscillations of air exceeding the audible frequency range of 50 Hz to 20 kHz and, in a broad sense, include all the elastic oscillations of gases, liquids, and solids other than the audible sound of air. In the embodiment, ultrasonic waves mean the elastic oscillations of a solid. Generally, assume that a rectangular plate has a thickness T, width W, length L, density $\rho$, and Young's modulus Y, and that such a rectangular plate undergoes the same displacement at opposite ends thereof (X=0 and Y=L). Then, assuming:

$$T << L,\ W << L \tag{1}$$

the displacement $\xi_1$ in the direction of thickness T is expressed as:

$$\xi_1 = \xi_0 \operatorname{Sin}(nX) \cdot \operatorname{Sin}(\omega_0 t) \tag{2}$$

where $\xi_0$ is a maximum displacement in the thickness direction and n is a positive integer, including zero, as is well known for Fourier series representations.

$$n^4 = 12\omega_0^2 \rho/(YT^2) \tag{3}$$

$$nL = 2\pi S$$

$$S = 1, 2, 3 \tag{4}$$

$$l = L/S$$

$$\omega_0 = (2\pi/l)^2 \times T(Y/12\rho)^{\frac{1}{2}} \tag{5}$$

where l is a wavelength.

Likewise, when the phase of $\pi/2$ is changed with respect to position and time:

$$\xi_2 = \xi_0 \cos(nX) \times \cos(\omega_0 t) \tag{6}$$

By combining the two kinds of oscillations, a progressive wave of flexural vibration is obtained, as follows:

$$\xi = \xi_1 + \xi_2 = \xi_0 \cos(nX - \omega_0 t) \tag{7}$$

A phase velocity $v$ is produced by:

$$v = \omega_0/n = (2\pi/l)T(Y/12\rho)^{\frac{1}{2}} \tag{8}$$

The oscillations are associated with a neutral plane and, on the surface of thickness T (position spaced apart by T/2 from the neutral plane, causes a displacement in the transversal direction (along the length L) which is expressed as:

$$\begin{aligned} \xi &= \xi_0 n(T/2) \times \sin(nX - \omega_0 t) \\ &= \pi\xi_0(T/l) \times \sin(nX - \omega_0 t) \end{aligned} \tag{9}$$

The above equations (7) and (9) indicate that the mass point on the surface is in an oval movement with a ratio of 1 (longitudinal direction): $\pi T/1$ (lateral direction). When the longitudinal displacement $\xi$ is maximum ($nX = \omega_0 t$), the lateral displacement $\zeta$ is minimum. The velocity U of the lateral displacement $\zeta$ is also maximum, as follows:

$$U = d\zeta/dt = -\omega_0\xi_0 (T/l) \times \cos(nX - \omega_0 t)$$

$$U\max = -\pi\omega_0\xi_0 T/l \tag{10}$$

Since the wave is a progressive wave, the maximum point of longitudinal displacement $\xi$ moves at the phase velocity $v$. However, an object contacting the peak moves in a given direction at the speed given by the above equation.

The ultrasonic transport members of the embodiment are implemented by the above-described principle.

As stated above, the embodiment transports the toner by using the principle of ultrasonic wave transport, i.e., without rotating the developing roller 161. This eliminates portions which would otherwise rub due to the rotation of the developing roller 161 and, therefore, frees the toner from stresses which would cause it to bind. Moreover, since the developing roller 161 does not rotate, eddy current which would increase the torque and generate heat is substantially eliminated, whereby the toner in the developing device is prevented from melting.

Figure 3:
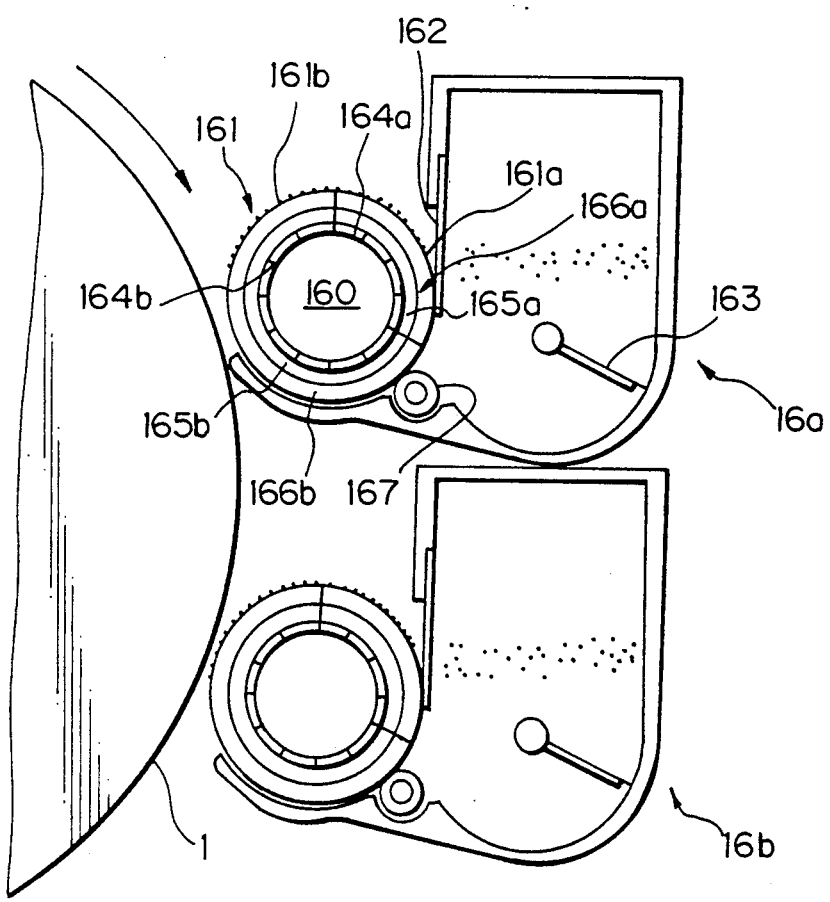
FIGS. 3, 4 and 5 are views each showing a developing unit representative of an alternative embodiment of the present invention.

Referring to FIG. 3, an alternative embodiment of the present invention will be described. As shown, the developing device is constituted by a first developing device 16*a* and a second developing device 16*b* each facing the drum 1 for developing a latent image in a particular color. Specifically, the first developing device 16*a* contains a one-component type non-magnetic toner of particular color such as red, while the second developing device 16*a* contains a non-magnetic black toner. The two developing devices 16*a* and 16*b* are identical in construction, except for the color of the toner. In each of the developing devices 16*a* and 16*b*, the ultrasonic transport members surrounding the shaft 160 of the developing roller 161 are each divided into two. Specifically, a plurality of electrodes 164*a*, a piezoelectric member 165*a* and a resilient member 166*a* define a transport path extending from the inside of the developing device to the outside by way of the position where the roller 161 contacts the blade 162. These electrodes 164*a*, piezoelectric member 165*a* and resilient member 166*a* will be referred to as first ultrasonic transport members hereinafter. A plurality of electrodes 164*b*, a piezoelectric member 165*b*, and an elastic member 166*b* constitute the other part of the transport path and will be referred to as second ultrasonic transport members. The two groups of electrodes 164*a* and 164*b* are each connected to an independent drive circuit to be driven independently of each other.

The developing devices 16*a* and 16*b* are selectively brought into an operative state on the basis of a conventional bicolor image forming process. While in operation, the developing devices 16*a* and 16*b* have their first and second transport members driven to transport the individual toners to the drum 1 and collect the toners remaining on the individual developing rollers after development 161, as in the previous embodiment. To prevent the toners of different colors from being mixed after development, the developing devices 16*a* and 16*b* are each brought into a state in which the toner does not exist on the second transport members that face the drum 1. Specifically, only the second transport members are driven to collect toner therefrom in the developing device. Should the first transport members be driven together with the second transport members, the toner in the developing device would be transported to the second transport members.

This embodiment is simpler in construction and smaller size than a conventional image forming apparatus of the type moving each developing device away from a photoconductive drum after development in order to prevent toners of different colors from being mixed. Of course, the embodiment is practicable with three or more developing devices and even with an image forming apparatus which allows the user to selectively mount a plurality of developing devices to produce a particular monocolor image. Further, when only a single developing device is incorporated in an image forming apparatus and removably mounted on the apparatus, the embodiment is successful in preventing a toner from existing on the portions of a developing roller which will be exposed to the inside and outside of the apparatus in the event of removal of the developing device.

Figure 4:
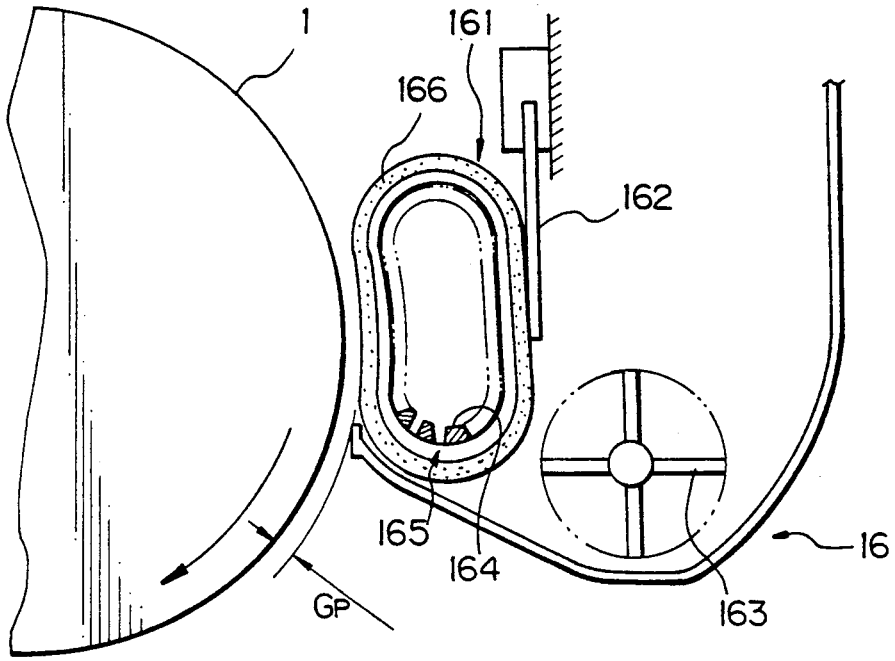

FIG. 4 shows another alternative embodiment of the present invention. In the embodiments described above, assuming a developing roller whose diameter is 40 millimeters by way of example, the nip for development usually extends over a width of 10 millimeters or so due to the circular contour of the roller, although it depends on the diameter of the photoconductive drum. Therefore, the developing ability is likely to become insufficient when, for example, it is desired to increase the image forming speed. It has been customary with an image forming apparatus of the type transporting a toner by rotating a developing roller to increase the image forming speed by increasing the rotation speed of the roller. This, however, requires a bulky drive mechanism for coping with a greater drive torque. In light of this, the embodiment of FIG. 4 achieves a higher developing ability with a simpler construction by providing the ulstrasonic transporting means with a unique surface configuration. Specifically, the ultrasonic transporting means is complementary in configuration to the photoconductive drum 1 at a position where the former faces the latter, thereby setting up a greater nip width for development than one achievable with roller-shaped developer transporting means.

In FIG. 4, the agitator 163 and blade 162 are provided in the developing device 16, as in the foregoing embodiments. In this embodiment, as well as the previous embodiment, the developer transporting means is implemented as ultrasonic transporting means, i.e., electrodes 164, piezoelectric member 165 (made of piezoelectric ceramic, for example), and elastic member 166 (made of rubber, foam material, etc). In the illustrative embodiment, the ultrasonic transporting means extends along the surface of the drum 1 in the position where it faces the drum 1, thereby defining a nip for development. In such a position, the surface of the drum 1 and that of the ultrasonic transporting means are uniformly spaced apart by a predetermined distance Gp. To transport the toner, currents which are different in phase are applied to the electrodes 164, as in the other embodiments. Since the nip width can be increased, compared to one particular to a roller-shaped transport member, the developing ability can be enhanced without complicating the construction or increasing the size of a developing device.

Figure 5:
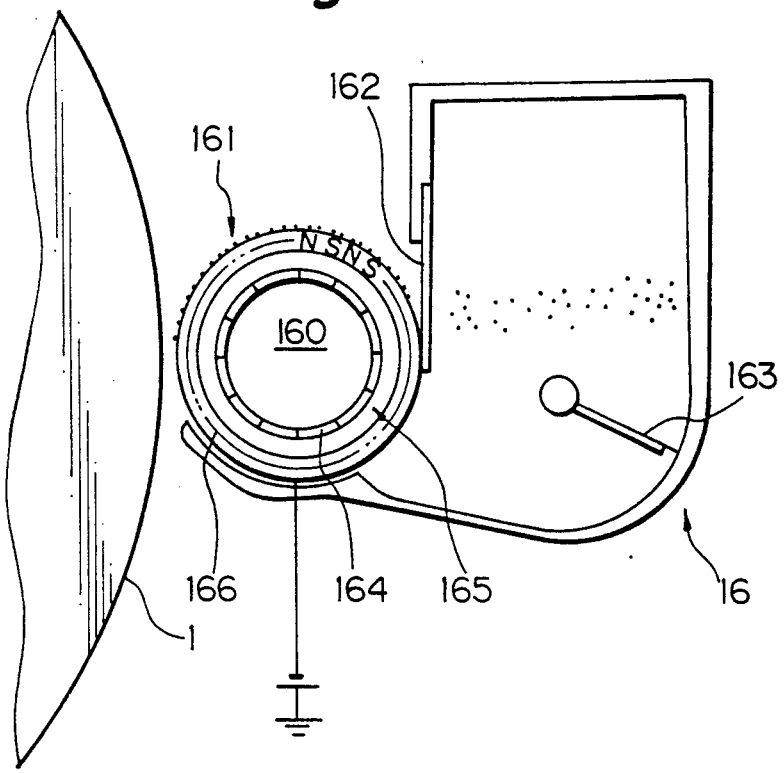

FIG. 5 shows a further alternative embodiment of the present invention which uses a magnetic one-component type toner for development. As shown, the developing device is essentially identical with the developing device of FIG. 2 except that the elastic member 166 of the ultrasonic transport members is implemented as a magnetic body having a number of magnetic poles. In this embodiment, the magnetic toner in the hopper is attracted onto the surface of the developing roller 161 by the magnetic field developed on the roller 161. The toner deposited on the developing roller 161 is transported to the surface of the drum 1 and collected by the ultrasonic transport having been described in relation to the previous embodiments. The elastic member 166 may be made of an organic magnetic substance to promote easy setting of a dielectric constant and to implement the member 166 as a thin film. For example, use may be made of ferrocene polymer belonging to a family of organic metallic polymers or COPNA type ferromagnetic resin which is a polymeric magnetic substance. Further, when the elastic member 166 is made of a dielectric substance, it will exert a counter electrode effect on an electrostatic latent image formed on the drum 1 to thereby enhance efficient development.

In summary, it will be seen that the present invention provides an image forming apparatus which makes it needless to rotate developer transporting means and, therefore, eliminates the binding of a toner in a developing device and the increase in the drive torque. Since the toner is transported without resorting to a conventional rotary member such as a rotary developing roller, it is prevented from being scattered around from the transporting member due to centrifugal forces and, therefore, from disturbing images due to smears. Further, it is not necessary to apply a bias voltage from a bias source via, for example, the bearings of a rotary member, eliminating faulty application of the bias voltage.

Ultrasonic transporting means of the invention is made up of first transport members defining a toner transport path which extends from the inside of the developing device toward the surface of an image carrier, and second transport members defining a toner transport path for collecting the toner fed out from the developing device. During development, both of the first and second transport members are driven to supply the toner from the developing device to the image carrier and to collect the toner remaining on the image carrier after development. When the toner existing in the portion of the transporting means which is exposed to the outside should be collected in the developing device, only the second transport members are driven to collect the toner existing thereon. Hence, in an image forming apparatus of the type having a plurality of developing devices each storing a toner of particular color and selectively operating them to produce a multicolor image, driving only the second transport members is successful in preventing the toners of different colors from being mixed on the image carrier without resorting to a mechanism for moving the transporting means relative to the image carrier. This not only simplifies the mechanism but also insures accurate position of the transporting means relative to the image carrier. On the other hand, in an image forming apparatus of the type having a single detachable developing device, driving only the second transport members before the removal of the developing device is successful in preventing the toner from being scattered around by a simple construction.

Since at least part of the surface of the transporting means that faces the surface of the image carrier is complementary in configuration to the latter surface, the transporting means faces the image carrier over a relatively broad range. Therefore, the developing ability and image forming speed can be increased without increasing the size of the transporting means.

When use is made of a magnetic toner, the transporting means is provided with a flexible member having multiple magnetic poles on a member which transforms an electrical input to mechanical oscillations. This, coupled with the fact that the flexible member is made of a dielectric material, eliminates leaks from a bias voltage source for development and emphasizes the electric field for development to thereby enhance efficient development. In addition, the flexible member may be made of an organic magnetic substance and thereby implemented as a thin film, insuring stable transport of the magnetic toner with ease.

Various modifications will become possible for those skilled in the art after receiving the teachings of the present disclosure without departing from the scope thereof.

What is claimed is:

1. In an image forming apparatus, comprising a developing device for developing a latent image electrostatically formed on an image carrier by a toner, said developing device comprising:

developer transporting means comprising a non-rotatable ultrasonic transporting means, wherein said non-rotatable ultrasonic transporting means is mounted non-rotatably in said image forming apparatus, has a roller-like configuration, and is enclosed by a cylindrical portion of the developer transporting means.

2. In an image forming apparatus, comprising a developing device for developing a latent image electrostaticly formed on an image carrier by a toner, said developing device comprising:

developer transporting means comprising an ultrasonic transporting means, wherein said ultrasonic transporting means comprises first ultrasonic transport members defining a first toner transport path extending from the interior of said developing device toward the surface of said image carrier, and second ultrasonic transport members defining a second toner transport path for collecting the toner fed out from said developing device along said first toner transport path in said developing device.

3. In an image forming apparatus, comprising a developing device for developing a latent image electrostaticly formed on an image carrier by a toner, said developing device comprising:

developer transporting means comprising an ultrasonic transporting means, wherein at least part of the surface of said ultrasonic transporting means which faces the surface of said image carrier is complementary in configuration to said surface of said image carrier.

4. In an image forming apparatus, comprising a developing device for developing a latent image electrostaticly formed on an image carrier by a toner, said developing device comprising:

developer transporting means comprising an ultrasonic transporting means, wherein said ultrasonic transporting means comprises a first member for transforming an electric input to mechanical oscillations, and a flexible second member provided on said first member and comprising multiple magnetic poles.

5. An apparatus as claimed in claim 4, wherein said flexible member is made of a dielectric material.

6. An apparatus as claimed in claim 4, wherein said flexible member is made of an organic magnetic substance.

* * * * *